US008318040B2

(12) United States Patent
Sawada et al.

(10) Patent No.: US 8,318,040 B2
(45) Date of Patent: Nov. 27, 2012

(54) REFRIGERATOR OIL AND WORKING FLUID COMPOSITION FOR REFRIGERATING MACHINE

(75) Inventors: Ken Sawada, Yokohama (JP); Yuji Shimomura, Yokohama (JP); Katsuya Takigawa, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 269 days.

(21) Appl. No.: 12/531,772

(22) PCT Filed: Mar. 11, 2008

(86) PCT No.: PCT/JP2008/054381

§ 371 (c)(1),
(2), (4) Date: Nov. 17, 2009

(87) PCT Pub. No.: WO2008/117657

PCT Pub. Date: Oct. 2, 2008

(65) Prior Publication Data

US 2010/0051854 A1 Mar. 4, 2010

(30) Foreign Application Priority Data

Mar. 27, 2007 (JP) ..... P2007-082696

(51) Int. Cl.
*C09K 5/04* (2006.01)

(52) U.S. Cl. ..... 252/68; 508/501

(58) Field of Classification Search ..... 252/68; 508/501

See application file for complete search history.

(56) References Cited

U.S. PATENT DOCUMENTS

| | | | | |
|---|---|---|---|---|
| 5,449,472 | A | 9/1995 | Egawa et al. | |
| 5,470,497 | A | 11/1995 | Schlosberg et al. | |
| 5,654,383 | A | 8/1997 | Koehler et al. | |
| 5,711,165 | A | 1/1998 | Iizuka et al. | |
| 5,964,581 | A | 10/1999 | Iizuka et al. | |
| 6,029,459 | A | 2/2000 | Iizuka et al. | |
| 6,153,118 | A | 11/2000 | Hasegawa et al. | |
| 6,221,274 | B1 | 4/2001 | Akahori et al. | |
| 6,228,282 | B1 | 5/2001 | Shimomura et al. | |
| 6,258,293 | B1 | 7/2001 | Iizuka et al. | |
| 6,350,392 | B1 | 2/2002 | Schnur | |
| 6,458,288 | B1 | 10/2002 | Kawaguchi et al. | |
| 6,582,621 | B1 | 6/2003 | Sasaki et al. | |
| 6,667,285 | B1 * | 12/2003 | Kawahara et al. | 508/485 |
| 6,692,654 | B2 * | 2/2004 | Osumi et al. | 252/68 |
| 6,759,373 | B2 * | 7/2004 | Tazaki | 508/462 |
| 6,858,571 | B2 | 2/2005 | Pham et al. | |
| 6,969,701 | B2 | 11/2005 | Singh et al. | |
| 6,998,065 | B1 | 2/2006 | Hasegawa et al. | |
| 7,018,558 | B2 | 3/2006 | Schnur et al. | |
| 7,052,626 | B1 | 5/2006 | Hasegawa et al. | |
| 7,569,170 | B2 | 8/2009 | Minor | |
| 7,993,543 | B2 * | 8/2011 | Tagawa et al. | 252/68 |
| 2001/0027655 | A1 | 10/2001 | Tazaki | |
| 2002/0123436 | A1 * | 9/2002 | Osumi et al. | 508/462 |
| 2004/0157753 | A1 | 8/2004 | Tazaki et al. | |
| 2004/0209789 | A1 | 10/2004 | Swallow et al. | |
| 2005/0127320 | A1 | 6/2005 | Fahl et al. | |
| 2006/0128576 | A1 | 6/2006 | Tazaki | |
| 2006/0243944 | A1 | 11/2006 | Minor et al. | |
| 2006/0255313 | A1 | 11/2006 | Yamada et al. | |
| 2006/0278845 | A1 | 12/2006 | Kajiki et al. | |
| 2007/0032391 | A1 | 2/2007 | Tagawa et al. | |
| 2007/0213239 | A1 | 9/2007 | Kaneko | |
| 2007/0257229 | A1 | 11/2007 | Tagawa et al. | |
| 2008/0157022 | A1 | 7/2008 | Singh et al. | |
| 2008/0230738 | A1 | 9/2008 | Minor et al. | |
| 2008/0237534 | A1 | 10/2008 | Kajiki et al. | |
| 2009/0200507 | A1 * | 8/2009 | Tagawa et al. | 252/68 |
| 2010/0038583 | A1 | 2/2010 | Shimomura et al. | |
| 2011/0248206 | A1 * | 10/2011 | Kaneko | 252/68 |

FOREIGN PATENT DOCUMENTS

| | | | |
|---|---|---|---|
| CN | 1433457 | | 7/2003 |
| EP | 0485979 | | 5/1992 |
| EP | 0571091 | | 11/1993 |
| EP | 571091 | | 11/1993 |
| EP | 992572 | A2 * | 4/2000 |
| EP | 1203807 | | 5/2002 |
| EP | 0568348 | | 11/2003 |
| EP | 1712607 | | 10/2006 |
| EP | 2161323 | | 3/2010 |
| JP | 56-131548 | | 10/1981 |
| JP | 2-242888 | | 9/1990 |
| JP | 3-088892 | | 4/1991 |
| JP | 3-128991 | | 5/1991 |
| JP | 3-128992 | | 5/1991 |
| JP | 3-200895 | | 9/1991 |
| JP | 3-217495 | | 9/1991 |
| JP | 3-227397 | | 10/1991 |

(Continued)

OTHER PUBLICATIONS

Search report from E.P.O. that issued with respect to patent family member European Patent Application No. 08721797.2, mail date is Apr. 12, 2011.

Search report from E.P.O. that issued with respect to patent family member European Patent Application No. 08843829.6, mail date is Aug. 2, 2011.

International Search Report issued with respect to PCT/JP2008/054381, mailed Jun. 3, 2008.

International Preliminary Report on Patentability, including the Written Opinion (in English) for PCT/JP2008/054381, mailed Oct. 29, 2009.

International Search Report for International Application No. PCT/JP2008/052651, mailed May 1, 2008.

International Preliminary Report on Patentability including the Written Opinion (in English) for International Application No. PCT/JP2008/052651, mailed Sep. 11, 2009.

(Continued)

*Primary Examiner* — Douglas McGinty

(74) *Attorney, Agent, or Firm* — Greenblum & Bernstein, P.L.C.

(57) ABSTRACT

The refrigerating machine oil of the invention is characterized by comprising an ester of a polyhydric alcohol and fatty acids with a content of a C10-C13 branched fatty acid of 50% by mole or greater. The working fluid composition for a refrigerating machine of the invention is characterized in that the working fluid composition comprises an ester of a polyhydric alcohol and fatty acids with a content of a C10-C13 branched fatty acid of 50% by mole or greater, and a refrigerant.

7 Claims, 1 Drawing Sheet

FOREIGN PATENT DOCUMENTS

| | | | |
|---|---|---|---|
| JP | 3-505602 | | 12/1991 |
| JP | 4-020597 | | 1/1992 |
| JP | 4-072390 | | 3/1992 |
| JP | 4-183788 | | 6/1992 |
| JP | 4-218592 | | 8/1992 |
| JP | 4-249593 | | 9/1992 |
| JP | 6-025690 | | 2/1994 |
| JP | 6-501518 | | 2/1994 |
| JP | 6-108081 | | 4/1994 |
| JP | 6-128578 | | 5/1994 |
| JP | 6-145104 | | 5/1994 |
| JP | 9-169991 | | 6/1997 |
| JP | 10-2044458 | | 8/1998 |
| JP | 11-236584 | | 8/1999 |
| JP | 2000-104084 | | 4/2000 |
| JP | 2000-297753 | | 10/2000 |
| JP | 2000-319678 | | 11/2000 |
| JP | 2001-506672 | | 5/2001 |
| JP | 2003-176488 | | 6/2003 |
| JP | 2005-514492 | | 5/2005 |
| JP | 2006-512426 | | 4/2006 |
| JP | 2007-510039 | | 4/2007 |
| JP | 2007-332134 | | 12/2007 |
| JP | 2008-208261 | | 9/2008 |
| JP | 2008-208262 | | 9/2008 |
| TW | 200634141 | | 10/2006 |
| WO | WO 90/05172 | A1 * | 5/1990 |
| WO | 90/12849 | | 11/1990 |
| WO | 93/01249 | | 1/1993 |
| WO | 2005/042663 | | 5/2005 |
| WO | 2005/085402 | | 9/2005 |
| WO | WO 2005085402 | A1 * | 9/2005 |
| WO | 2005/103190 | | 11/2005 |
| WO | 2005/103191 | | 11/2005 |
| WO | 2006/069362 | | 6/2006 |
| WO | 2006/094303 | | 9/2006 |
| WO | 2007/105718 | | 9/2007 |
| WO | WO 2007108484 | A1 * | 9/2007 |

OTHER PUBLICATIONS

International Search Report for International Application No. PCT/JP2008/053182, mailed May 1, 2008.

International Preliminary Report on Patentability including the Written Opinion (in English) for International Application No. PCT/JP2008/053182, mailed Sep. 1, 2009.

International Search Report that issued with respect to PCT/JP2008/068974, mailed Nov. 18, 2008.

International Preliminary Report on Patentability, including the Written Opinion (in English) for PCT/JP2008/068974, mailed Jun. 10, 2010.

Office action that issued with respect to Russian Patent Application No. 2009135830/04, dated Jul. 28, 2011, along with an english translation thereof.

Office Action mailed Nov. 30, 2011, U.S. Appl. No. 12/521,934.

China Office action that issued with respect to patent family member Chinese Patent Application No. 200880001331.X, mail date is Jan. 18, 2012.

China Office action that issued with respect to Chinese Patent Application No. 200880000976.1, mail date is Nov. 24, 2011.

* cited by examiner

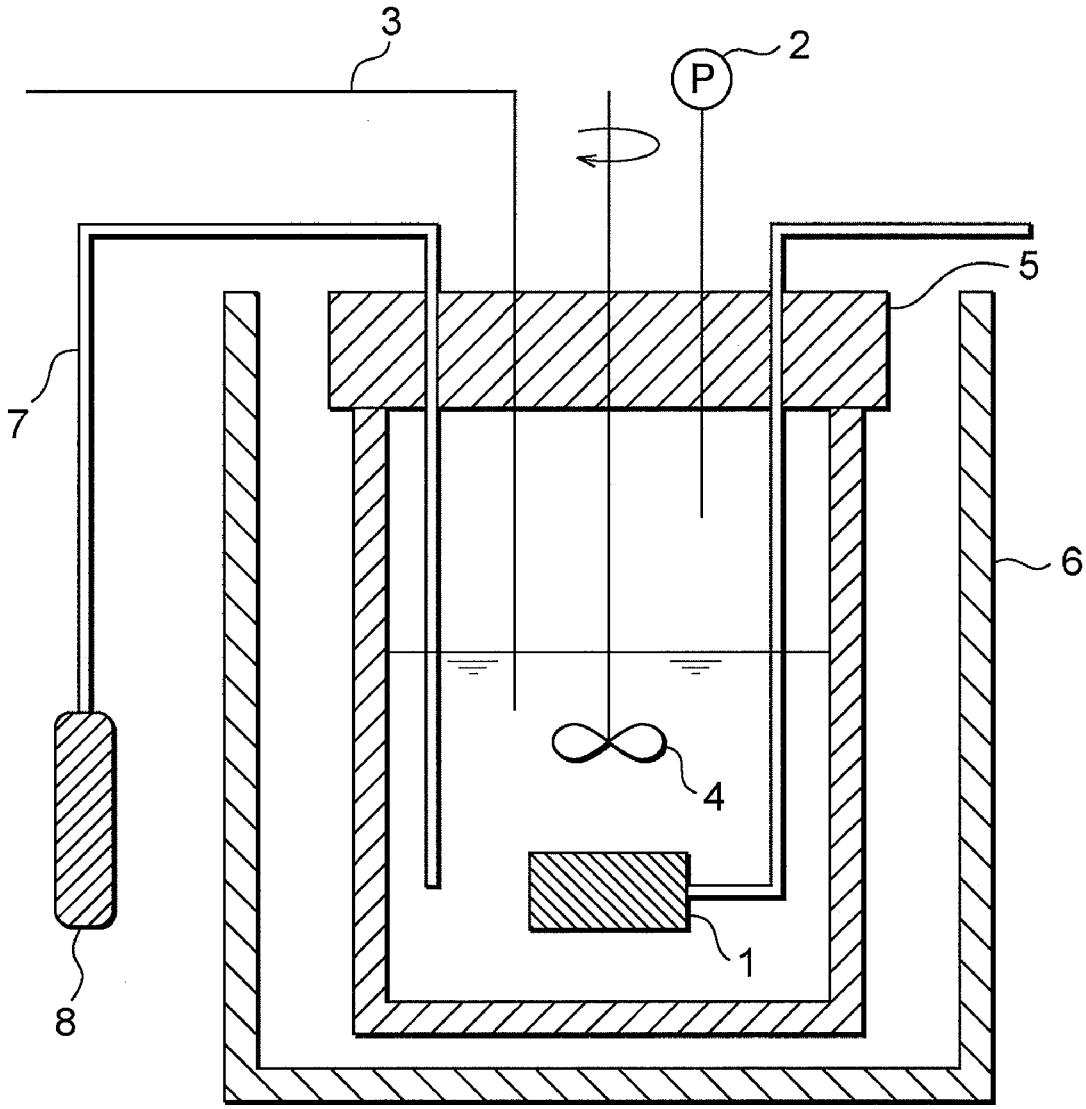
3
2
P
5
7
6
4
1
8

REFRIGERATOR OIL AND WORKING FLUID COMPOSITION FOR REFRIGERATING MACHINE

TECHNICAL FIELD

The present invention relates to a refrigerating machine oil used in a refrigerating air conditioner, and to a working fluid composition for a refrigerating machine.

BACKGROUND ART

In light of the problem of ozone layer depletion in recent years, the restrictions on CFCs (chlorofluorocarbons) and HCFCs (hydrochlorofluorocarbons) that are used as refrigerants in conventional refrigerating air conditioners have become more stringent, and HFCs (hydrofluorocarbons) are coming into use as substitute refrigerants. However, HFC refrigerants are also associated with problems such as increased contribution to global warming, and the use of natural refrigerants as substitutes for such fluorocarbon refrigerants is currently being researched. Among such refrigerants, carbon dioxide refrigerants are known to be harmless to the environment and highly safe, while also having advantages such as compatibility with oils and machine materials and being readily available. Research has also recently begun on their use as refrigerants for automobile air conditioners that employ open type compressors or hermetic type electrical compressors.

Esters which are compatible with HFC refrigerants, carbonic acid esters, PAG (polyalkylene glycols), polyvinyl ethers and the like have been either investigated or employed as refrigerating machine oils for HFC refrigerants (see Patent documents 1-10, for example). Also, ester-based refrigerating machine oils, for example, are used as refrigerating machine oils for carbon dioxide refrigerants (see Patent document 11, for example).

As a goal in many fields in recent years continues to be that of increasing energy savings, efforts have been directed toward achieving energy savings in the field of refrigerating air conditioners as well, by improving thermal efficiency and reducing power consumption. Techniques have been proposed for improving energy efficiency by lowering the viscosity of refrigerating machine oils, as an energy saving strategy from the viewpoint of the refrigerating machine oil (see Patent documents 12 and 13, for example).

[Patent document 1] Published Japanese Translation of PCT Application HEI No. 3-505602

[Patent document 2] Japanese Patent Application Laid-Open HEI No. 3-88892

[Patent document 3] Japanese Patent Application Laid-Open HEI No. 3-128991

[Patent document 4] Japanese Patent Application Laid-Open HEI No. 3-128992

[Patent document 5] Japanese Patent Application Laid-Open HEI No. 3-200895

[Patent document 6] Japanese Patent Application Laid-Open HEI No. 3-227397

[Patent document 7] Japanese Patent Application Laid-Open HEI No. 4-20597

[Patent document 8] Japanese Patent Application Laid-Open HEI No. 4-72390

[Patent document 9] Japanese Patent Application Laid-Open HEI No. 4-218592

[Patent document 10] Japanese Patent Application Laid-Open HEI No. 4-249593

[Patent document 11] Japanese Patent Application Laid-Open No. 2000-104084

[Patent document 12] Japanese Patent Application Laid-Open HEI No. 10-204458

[Patent document 13] Japanese Patent Application Laid-Open No. 2000-297753

DISCLOSURE OF THE INVENTION

Problems to be Solved by the Invention

The conventional refrigerating machine oils described above, however, are still in need of improvement.

Specifically, in the field of refrigerating air conditioners, refrigerant compatibility has been a major factor in evaluating the performance of refrigerating machine oils, as mentioned above. However, high compatibility of a refrigerating machine oil with a refrigerant leads to dissolution of the refrigerant and lowers the viscosity of the refrigerating machine oil, resulting in insufficient lubricity. More specifically, when the refrigerant dissolves in the refrigerating machine oil in the refrigeration system, thus lowering the viscosity of the fluid composition that is a mixture of the refrigerating machine oil and refrigerant (the refrigerant dissolved viscosity), this can potentially cause problems such as blow-by at the compression zone of the refrigerant compressor, or poor lubrication, or similar problems.

Increasing the viscosity is one method designed to improve lubricity, but increased viscosity of the refrigerating machine oil is not desirable from the viewpoint of energy savings and handleability. As an energy savings strategy based on the refrigerating machine oil used in a refrigerating air conditioner, it is necessary to lower the viscosity of the refrigerating machine oil to improve energy efficiency and lower the stirring resistance within the refrigerant compressor, whereas increasing the viscosity of the refrigerating machine oil runs contradictory to the concept of achieving energy savings.

In addition, refrigerating machine oils that are used with refrigerants have significantly different environments than other lubricating oils used in open air environments, for example. This is one reason that the techniques for improving lubricity in other lubricating oil fields cannot be directly applied to refrigerating machine oils.

Moreover, the refrigerant compatibility is impaired if the refrigerant dissolved viscosity is maintained by increasing the viscosity of the refrigerating machine oil, and this can be a separate cause of potential lubrication defects. That is, as part of the mechanism of the refrigerant circulation system in a refrigerating air conditioner, a portion of the refrigerating machine oil in the refrigerant compressor is discharged into the circulating fluid channel together with the refrigerant. In order to prevent lubrication defects caused by insufficient refrigerating machine oil in the refrigerant compressor, therefore, it is important for the discharged refrigerating machine oil to pass through the circulating fluid channel and return to the refrigerant compressor (oil recirculation), and reduced refrigerant compatibility is not desirable from the viewpoint of oil recirculation.

The difficulty in achieving both lower viscosity of the refrigerating machine oil and maintenance of the refrigerant dissolved viscosity, which are in a reciprocal relationship, and the difficulty in achieving both refrigerant compatibility for the refrigerating machine oil and maintenance of the refrigerant dissolved viscosity, are common problems faced in the development of refrigerating machine oils that are to be used together with HFC refrigerants, carbon dioxide refrigerants and the like, but these difficulties become even more obstructive when using carbon dioxide refrigerants, because reduction in the refrigerant dissolved viscosity becomes even more prominent.

The present invention has been accomplished in light of the circumstances referred to above, and its object is to provide a refrigerating machine oil that allows both reduced viscosity and refrigerant dissolved viscosity maintenance to be achieved, while also making it possible to both obtain refrigerating machine oil refrigerant compatibility and maintain refrigerant dissolved viscosity.

Means for Solving the Problems

In order to achieve the object stated above, the present inventors first examined how to improve the refrigerant dissolved viscosity of ester-based refrigerating machine oils with carbon dioxide refrigerants when they are used together with carbon dioxide refrigerants which are thought to present particular difficulty in achieving the aforementioned object. As a result, it was found that the fatty acid composition of fatty acid/polyhydric alcohol esters is an important deciding factor on the refrigerant dissolved viscosity in the presence of carbon dioxide refrigerants. Upon much further research based on this finding, the present inventors have discovered that the problems described above can be solved by using a fatty acid with a specific fatty acid composition as the constituent fatty acid of the ester and a polyhydric alcohol as the constituent alcohol, and the invention has been completed upon this discovery.

Specifically, the refrigerating machine oil of the invention is characterized by comprising an ester of a polyhydric alcohol and fatty acids with a content of a C10-C13 branched fatty acid of 50% by mole or greater (hereinafter referred to as "ester of the invention").

The refrigerating machine oil of the invention having the construction described above, even when used with a carbon dioxide refrigerant, can provide both lower viscosity of the refrigerating machine oil and maintenance of the refrigerant dissolved viscosity, which are in a reciprocal relationship, as well as both refrigerant compatibility and maintenance of refrigerant dissolved viscosity. The refrigerating machine oil of the invention also has excellent chemical stability and electrical insulating properties. Therefore, when the refrigerating machine oil of the invention is used it can exhibit a high level of refrigerant gas sealing properties for sliding sections of refrigerant compressors, lubricity for sliding sections and energy efficiency for refrigerant compressors, and can therefore contribute to both increased energy savings and high reliability for refrigerating air conditioners.

In the refrigerating machine oil of the invention, the proportion of tertiary carbons among the constituent carbons of the fatty acids composing the ester of the invention is preferably 2% by mass or greater, as measured by $^{13}$C-NMR analysis.

There are no particular restrictions on the refrigerant used in the refrigerating air conditioner to which the refrigerating machine oil of the invention is applied, but the refrigerating machine oil of the invention exhibits the aforementioned superior effect especially when used together with carbon dioxide refrigerants.

The invention further provides a working fluid composition for a refrigerating machine characterized in that the working fluid composition comprises an ester of a polyhydric alcohol and fatty acids with a content of a C10-C13 branched fatty acid of 50% by mole or greater, and a refrigerant.

The working fluid composition for a refrigerating machine according to the invention contains a refrigerating machine oil of the invention as described above, and therefore even when it contains a carbon dioxide refrigerant, it is possible to achieve both lower viscosity of the refrigerating machine oil and maintenance of the refrigerant dissolved viscosity, which are in a reciprocal relationship, as well as both refrigerant compatibility and maintenance of refrigerant dissolved viscosity. The refrigerating machine oil of the invention also has excellent chemical stability and electrical insulating properties. Therefore, when a working fluid composition for a refrigerating machine according to the invention is used, it can exhibit a high level of refrigerant gas sealing properties for the sliding sections of refrigerant compressors, lubricity for the sliding sections and energy efficiency for refrigerant compressors, and can therefore contribute to both increased energy savings and high reliability for refrigerating air conditioners.

There are no particular restrictions on the refrigerant used in the working fluid composition for a refrigerating machine according to the invention, but the aforementioned superior effect is exhibited especially when the refrigerant is a carbon dioxide refrigerant.

Effect of the Invention

As mentioned above, the invention provides a refrigerating machine oil and a working fluid composition for a refrigerating machine, that allow both reduced viscosity and refrigerant dissolved viscosity maintenance to be achieved, while also making it possible to obtain both refrigerating machine oil refrigerant compatibility and refrigerant dissolved viscosity maintenance.

BRIEF DESCRIPTION OF THE DRAWINGS

FIG. 1 is a general schematic drawing of an apparatus for measuring refrigerant dissolved viscosity, used for the examples.

EXPLANATION OF SYMBOLS

1: Viscometer, 2: pressure gauge, 3: thermocouple, 4: stirrer, 5: pressure vessel, 6: thermostatic bath, 7: fluid channel, 8: sampling cylinder.

BEST MODE FOR CARRYING OUT THE INVENTION

Preferred embodiments of the invention will now be described in detail.

The refrigerating machine oil of the invention is characterized by comprising a polyol ester of a polyhydric alcohol and fatty acids wherein the proportion of C10-C13 branched fatty acids among the fatty acids is 50% by mole or greater. The working fluid composition for a refrigerating machine according to the invention is characterized by comprising an ester of a polyhydric alcohol and fatty acids with a content of a C10-13 branched fatty acid of 50% by mole or greater, and a refrigerant. The working fluid composition for a refrigerating machine according to the invention encompasses any mode which contains a refrigerating machine oil of the invention and a refrigerant.

An ester used for the invention must have a proportion of C10-C13 fatty acids among the constituent fatty acids of 50% by mole or greater, preferably 60-100% by mole, even more preferably 80-100% by mole and most preferably 90-100% by mole, from the viewpoint of ensuring compatibility and suitable refrigerant dissolved viscosity in the presence of carbon refrigerants. The proportion of C10-C13 fatty acids is preferably not less than 50% by mole because it will not be possible to achieve both compatibility with carbon dioxide refrigerants and refrigerant dissolved viscosity in the presence of carbon dioxide refrigerants.

An ester used for the invention must also have a proportion of C13 branched fatty acids among the constituent fatty acids of 50% by mole or greater, preferably 60-100% by mole and even more preferably 70-100% by mole, from the viewpoint of ensuring compatibility and suitable refrigerant dissolved viscosity in the presence of carbon dioxide refrigerants.

The constituent fatty acids may include only branched fatty acids or they may be mixtures of branched fatty acids and straight-chain fatty acids, so long as the aforementioned condition of the C10-C13 branched fatty acid content is satisfied. The constituent fatty acids may also contain fatty acids other than C10-C13 branched fatty acids. As examples of fatty acids other than C10-C13 branched fatty acids there may be mentioned C6-24 straight-chain fatty acids and C6-C9 and C14-C24 branched fatty acids, and more specifically straight-chain or branched hexanoic acids, straight-chain or branched heptanoic acids, straight-chain or branched octanoic acids, straight-chain or branched nonanoic acids, straight-chain decanoic acids, straight-chain undecanoic acids, straight-chain dodecanoic acids, straight-chain tridecanoic acids, straight-chain or branched tetradecanoic acids, straight-chain or branched pentadecanoic acids, straight-chain or branched hexadecanoic acids, straight-chain or branched heptadecanoic acids, straight-chain or branched octadecanoic acids, straight-chain or branched nonadecanoic acids, straight-chain or branched eicosanoic acids, straight-chain or branched heneicosanoic acids, straight-chain or branched docosanoic acids, straight-chain or branched tricosanoic acids and straight-chain or branched tetracosanoic acids.

An ester used for the invention preferably has a proportion of tertiary carbons, among the constituent carbons of the constituent fatty acids, of 2% by mass or greater, preferably 2-10% by mass and even more preferably 2.5-5% by mass, from the viewpoint of balance between compatibility and refrigerant dissolved viscosity. The proportion of tertiary carbon atoms can be determined by $^{13}$C-NMR analysis.

The polyhydric alcohol in the ester used for the invention is preferably a polyhydric alcohol with 2-6 hydroxyl groups. From the viewpoint of obtaining a high level of lubricity in the presence of carbon dioxide refrigerants, it is preferred to use a polyhydric alcohol with 4-6 hydroxyl groups. Low viscosity is sometimes desired for refrigerating machine oils for carbon dioxide refrigerants from the viewpoint of energy efficiency, and when a polyhydric alcohol with two or three hydroxyls is used as the polyhydric alcohol of the ester used for the invention it is possible to achieve satisfactory levels of both lubricity and low viscosity in the presence of carbon dioxide refrigerants.

As specific examples of dihydric alcohols (diols) there may be mentioned ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol, 1,12-dodecanediol and the like. As specific examples of trihydric and greater alcohols there may be mentioned polyhydric alcohols such as trimethylolethane, trimethylolpropane, trimethylolbutane, di-(trimethylolpropane), tri-(trimethylolpropane), pentaerythritol, di-(pentaerythritol), tri-(pentaerythritol), glycerin, polyglycerin (glycerin 2-20mers), 1,3,5-pentanetriol, sorbitol, sorbitan, sorbitolglycerin condensation products, adonitol, arabitol, xylitol, mannitol and the like, saccharides such as xylose, arabinose, ribose, rhamnose, glucose, fructose, galactose, mannose, sorbose, cellobiose, maltose, isomaltose, trehalose, sucrose, raffinose, gentianose and melezitose, as well as partial etherified forms and methylglucosides (glucosides) of the same. Preferred among these are hindered alcohols such as neopentyl glycol, trimethylolethane, trimethylolpropane, trimethylolbutane, di-(trimethylolpropane), tri-(trimethylolpropane), pentaerythritol, di-(pentaerythritol) and tri-(pentaerythritol).

The ester used for the invention may be a partial ester with a portion of the hydroxyl groups of the polyhydric alcohol remaining as hydroxyl groups without esterification, a complete ester with all of the hydroxyl groups esterified, or a mixture of a partial ester and a complete ester, but it is preferably a complete ester.

For more excellent hydrolytic stability, the ester used for the invention is more preferably an ester of a hindered alcohol such as neopentyl glycol, trimethylolethane, trimethylolpropane, trimethylolbutane, di-(trimethylolpropane), tri-(trimethylolpropane), pentaerythritol, di-(pentaerythritol) or tri-(pentaerythritol), even more preferably an ester of neopentyl glycol, trimethylolethane, trimethylolpropane, trimethylolbutane or pentaerythritol, even more preferably an ester of pentaerythritol, trimethylolpropane or neopentyl glycol, and most preferably a pentaerythritol ester for especially superior compatibility with refrigerants and hydrolytic stability.

The ester used for the invention may be a single type of ester having only one type of structure, or it may be a mixture of two or more ester with different structures.

The ester used for the invention may be an ester of one fatty acid and one polyhydric alcohol, an ester of two or more fatty acids and one polyhydric alcohol, an ester of one fatty acid and two or more polyhydric alcohols, or an ester of two or more fatty acids and two or more polyhydric alcohols. Of these, particularly excellent low-temperature characteristics and compatibility with refrigerants are exhibited by polyol esters employing mixed fatty acids, and especially polyol esters comprising two or more fatty acids in the ester molecule.

There are no particular restrictions on the content of the ester used for the invention in a refrigerating machine oil of the invention, but for more excellent performance including lubricity, refrigerant compatibility, thermal/chemical stability and electrical insulating properties, the content is preferably at least 50% by mass, more preferably at least 70% by mass, even more preferably at least 80% by mass and most preferably at least 90% by mass, based on the total amount of the refrigerating machine oil.

The refrigerating machine oil of the invention may consist entirely of an ester according to the invention, or it may further comprise a base oil other than an ester according to the invention. As base oils other than an ester according to the invention there may be used hydrocarbon-based oils including mineral oils, olefin polymers, naphthalene compounds, alkylbenzenes and the like, ester-based base oils other than esters according to the invention (monoesters, and polyol esters containing only straight-chain fatty acids as constituent fatty acids), and oxygen-containing synthetic oils such as polyglycols, polyvinyl ethers, ketones, polyphenyl ethers, silicones, polysiloxanes and perfluoroethers. As oxygen-containing synthetic oils, among those mentioned above, there are preferred ester-based base oils other than esters according to the invention, polyglycols and polyvinyl ethers.

The refrigerating machine oil of the invention which comprises an ester according to the invention may be suitably used even without additives, but various additives may also be included if necessary.

In order to further enhance the antiwear property and load carrying capacity of the refrigerating machine oil of the invention, there may be added one or more phosphorus compounds selected from the group consisting of phosphoric acid esters, acidic phosphoric acid esters, thiophosphoric acid esters, acidic phosphoric acid ester amine salts, chlorinated phosphoric acid esters and phosphorous acid esters. These phosphorus compounds are esters of phosphoric acid or phosphorous acid with alkanols or polyether alcohols, or derivatives thereof.

As specific examples of phosphoric acid esters there may be mentioned tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate and xylenyldiphenyl phosphate.

As acidic phosphoric acid esters there may be mentioned monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate and dioleyl acid phosphate.

As thiophosphoric acid esters there may be mentioned tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate and xylenyldiphenyl phosphorothionate.

As amine salts of acidic phosphoric acid esters there may be mentioned salts of amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine and trioctylamine, of the aforementioned acidic phosphoric acid esters.

As chlorinated phosphoric acid esters there may be mentioned Tris-dichloropropyl phosphate, Tris-chloroethyl phosphate, Tris-chlorophenyl phosphate, polyoxyalkylene-bis[di(chloroalkyl)]phosphate and the like. As phosphorous acid esters there may be mentioned dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite and tricresyl phosphite. Mixtures of the above compounds may also be used.

When the refrigerating machine oil of the invention contains such phosphorus compounds, the phosphorus compound content is not particularly restricted but is preferably 0.01-5.0% by mass and more preferably 0.02-3.0% by mass based on the total amount of the refrigerating machine oil (the total amount of the base oil and all of the additives). A single phosphorus compound may be used or two or more may be used in combination.

In order to further improve the stability of the refrigerating machine oil of the invention, it may contain one or more epoxy compounds selected from among phenylglycidyl ether-type epoxy compounds, alkylglycidyl ether-type epoxy compounds, glycidyl ester-type epoxy compounds, allyloxirane compounds, alkyloxirane compounds, alicyclic epoxy compounds, epoxidated fatty acid monoesters and epoxidated vegetable oils.

Specific examples of phenylglycidyl ether-type epoxy compounds include phenylglycidyl ethers and alkylphenylglycidyl ethers. An alkylphenylglycidyl ether is one having 1-3 C1-C13 alkyl groups, and preferred examples with C4-C10 alkyl groups include n-butylphenylglycidyl ether, i-butylphenylglycidyl ether, sec-butylphenylglycidyl ether, tert-butylphenylglycidyl ether, pentylphenylglycidyl ether, hexylphenylglycidyl ether, heptylphenylglycidyl ether, octylphenylglycidyl ether, nonylphenylglycidyl ether and decylphenylglycidyl ether.

Specific examples of alkylglycidyl ether-type epoxy compounds include decylglycidyl ether, undecylglycidyl ether, dodecylglycidyl ether, tridecylglycidyl ether, tetradecylglycidyl ether, 2-ethylhexylglycidyl ether, neopentyl glycol diglycidyl ether, trimethylolpropanetriglycidyl ether, pentaerythritoltetraglycidyl ether, 1,6-hexanediol diglycidyl ether, sorbitolpolyglycidyl ether, polyalkyleneglycol monoglycidyl ether and polyalkyleneglycol diglycidyl ether.

As specific examples of glycidyl ester-type epoxy compounds there may be mentioned phenylglycidyl esters, alkylglycidyl esters and alkenylglycidyl esters, among which preferred examples include glycidyl-2,2-dimethyl octanoate, glycidyl benzoate, glycidyl acrylate and glycidyl methacrylate.

Specific examples of allyloxirane compounds include 1,2-epoxystyrene and alkyl-1,2-epoxystyrenes.

Specific examples of alkyloxirane compounds include 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1,2-epoxyoctadecane, 2-epoxynonadecane and 1,2-epoxyeicosane.

Specific examples of alicyclic epoxy compounds include 1,2-epoxycyclohexane, 1,2-epoxycyclopentane, 3,4-epoxycyclohexylmethyl-3,4-epoxycyclohexane carboxylate, bis(3,4-epoxycyclohexylmethyl)adipate, exo-2,3-epoxynorbornane, bis(3,4-epoxy-6-methylcyclohexylmethyl)adipate, 2-(7-oxabicyclo[4.1.0]hept-3-yl)-spiro(1,3-dioxane-5,3'-[7]oxabicyclo[4.1.0]heptane, 4-(1'-methylepoxyethyl)-1,2-epoxy-2-methylcyclohexane and 4-epoxyethyl-1,2-epoxycyclohexane.

Specific examples of epoxidated fatty acid monoesters include epoxidated esters of C12-C20 fatty acids and C1-C8 alcohols or phenols or alkylphenols. Most preferably used are butyl, hexyl, benzyl, cyclohexyl, methoxyethyl, octyl, phenyl and butylphenyl esters of epoxystearic acid.

Specific examples of epoxidated vegetable oils include epoxy compounds of vegetable oils such as soybean oil, linseed oil and cottonseed oil.

Preferred among these epoxy compounds are phenylglycidyl ether-type epoxy compounds, glycidyl ester-type epoxy compounds, alicyclic epoxy compounds and epoxidated fatty acid monoesters. More preferred among these are phenylglycidyl ether-type epoxy compounds and glycidyl ester-type epoxy compounds, with phenylglycidyl ether, butylphenylglycidyl ether, alkylglycidyl ester or mixtures thereof being especially preferred.

When the refrigerating machine oil of the invention contains such epoxy compounds, the epoxy compound content is not particularly restricted but is preferably 0.1-5.0% by mass and more preferably 0.2-2.0% by mass based on the total amount of the refrigerating machine oil. A single epoxy compound may be used, or two or more may be used in combination.

If necessary in order to further enhance the performance of the refrigerating machine oil of the invention, it may contain refrigerating machine oil additives that are known in the prior art. As examples of such additives there may be mentioned phenol-based antioxidants such as di-tert-butyl-p-cresol and bisphenol A, amine-based antioxidants such as phenyl-α-naphthylamine and N,N-di(2-naphthyl)-p-phenylenediamine, anti-wear agents such as zinc dithiophosphate, extreme-pressure agents such as chlorinated paraffins and sulfur compounds, oiliness improvers such as fatty acids, silicone-based and other types of antifoaming agents, metal deactivators such as benzotriazoles, viscosity index improvers, pour point depressants, detergent dispersants and the like. Such additives may be used alone or in combinations of two or more. There are no particular restrictions on the content of such additives, but it is preferably not greater than 10% by mass and more preferably not greater than 5% by mass based on the total amount of the refrigerating machine oil.

The kinematic viscosity of the refrigerating machine oil of the invention is not particularly restricted, but the kinematic viscosity at 40° C. is preferably 3-1000 $mm^2/s$, more preferably 4-500 $mm^2/s$ and most preferably 5-400 $mm^2/s$. The kinematic viscosity at 100° C. is preferably 1-100 $mm^2/s$ and more preferably 2-50 $mm^2/s$.

The volume resistivity of the refrigerating machine oil for carbon dioxide refrigerants according to the invention is also not particularly restricted, but is preferably $1.0\times10^{12}$ Ω·cm or greater, more preferably $1.0\times10^{13}$ Ω·cm or greater and most preferably $1.0\times10^{14}$ Ω·cm or greater. High electrical insulating properties will usually be required for use in hermetic type refrigerating machine devices. According to the invention, the volume resistivity is the value measured according to JIS C 2101, "Electrical Insulation Oil Test Method", at 25° C.

The moisture content of the refrigerating machine oil of the invention is not particularly restricted but is preferably no greater than 200 ppm, more preferably no greater than 100 ppm and most preferably no greater than 50 ppm based on the total amount of the refrigerating machine oil. A lower moisture content is desired from the viewpoint of effect on the stability and electrical insulating properties of the oil, especially for use in sealed refrigerating machine devices.

The acid value of the refrigerating machine oil of the invention is also not particularly restricted, but in order to prevent corrosion of metals used in the refrigerating machine device or pipings, and in order to prevent decomposition of the ester oil in the refrigerating machine oil of the invention, it is preferably not greater than 0.1 mgKOH/g and more preferably not greater than 0.05 mgKOH/g. The acid value according to the invention is the value measured based on JIS K 2501, "Petroleum products and lubricants–Determination of neutralization number".

The ash content of the refrigerating machine oil of the invention is not particularly restricted, but in order to increase the stability of the refrigerating machine oil of the invention and inhibit generation of sludge, it is preferably not greater than 100 ppm and more preferably not greater than 50 ppm. According to the invention, the ash content is the value measured based on JIS K2272, "Crude oil and petroleum products–Determination of ash and sulfates ash".

The refrigerating machine oil of the invention exhibits an excellent effect when used with carbon dioxide refrigerants, but the refrigerant used may be a single carbon dioxide refrigerant, a single refrigerant other than a carbon dioxide refrigerant, or a refrigerant mixture comprising a carbon dioxide refrigerant and another refrigerant. As refrigerants other than carbon dioxide refrigerants there may be mentioned HFC refrigerants, fluorinated ether-based refrigerants such as perfluoroethers, tetrafluoropropene, trifluoroiodomethane, dimethyl ether, ammonia, hydrocarbons and the like.

As HFC refrigerants there may be mentioned C1-C3 and preferably C1-C2 hydrofluorocarbons. As specific examples there may be mentioned HFCs such as difluoromethane (HFC-32), trifluoromethane (HFC-23), pentafluoroethane (HFC-125), 1,1,2,2-tetrafluoroethane (HFC-134), 1,1,1,2-tetrafluoroethane (HFC-134a), 1,1,1-trifluoroethane (HFC-143a), 1,1-difluoroethane (HFC-152a) and the like, or mixtures of any two or more thereof. These refrigerants may be appropriately selected depending on the purpose of use and the required performance, but as preferred examples there may be mentioned HFC-32 alone; HFC-23 alone; HFC-134a alone; HFC-125 alone; HFC-134a/HFC-32=60-80% by mass/40-20% by mass mixture; HFC-32/HFC-125=40-70% by mass/60-30% by mass mixture: HFC-125/HFC-143a=40-60% by mass/60-40% by mass mixture; HFC-134a/HFC-32/HFC-125=60% by mass/30% by mass/10% by mass mixture; HFC-134a/HFC-32/HFC-125=40-70% by mass/15-35% by mass/5-40% by mass mixture; and HFC-125/HFC-134a/HFC-143a=35-55% by mass/1-15% by mass/40-60% by mass mixture. More specifically, there may be mentioned HFC-134a/HFC-32=70/30% by mass mixture; HFC-32/HFC-125=60/40% by mass mixture; HFC-32/HFC-125=50/50% by mass mixture (R410A); HFC-32/HFC-125=45/55% by mass mixture (R410B); HFC-125/HFC-143a=50/50% by mass mixture (R507c); HFC-32/HFC-125/HFC-134a=30/10/60% by mass mixture; HFC-32/HFC-125/HFC-134a=23/25/52% by mass mixture (R407c); HFC-32/HFC-125/HFC-134a=25/15/60% by mass mixture (R407E); and HFC-125/HFC-134a/HFC-143a=44/4/52% by mass mixture (R404A).

As specific fluorinated ether-based refrigerants there may be mentioned HFE-134p, HFE-245 mc, HFE-236 mf, HFE-236 me, HFE-338 mcf, HFE-365 mc-f, HFE-245 mf, HFE-347 mmy, HFE-347 mcc, HFE-125, HFE-143 m, HFE-134 m and HFE-227 me.

As tetrafluoropropene refrigerants there may be mentioned 1,3,3,3-tetrafluoropropene (HFO-1234ze), 2,3,3,3-tetrafluoropropene (HFO-1234yf) and the like.

As hydrocarbon refrigerants there are preferably used those that are gases at 25° C., 1 atmosphere. More specifically preferred are C1-C5 and preferably C1-C4 alkanes, cycloalkanes and alkenes, and their mixtures. Specific examples thereof include methane, ethylene, ethane, propylene, propane, cyclopropane, butane, isobutane, cyclobutane, methylcyclopropane and mixtures of two or more of the above. Preferred among the above are propane, butane, isobutane and their mixtures.

There are no particular restrictions on the mixing ratio between carbon dioxide and an HFC refrigerant, fluorinated ether-based refrigerant, dimethyl ether or ammonia, but the total amount of refrigerant used with a carbon dioxide refrigerant is preferably 1-200 parts by mass and more preferably 10-100 parts by mass with respect to 100 parts by mass of carbon dioxide. As a preferred mode there may be mentioned refrigerant mixtures comprising a carbon dioxide refrigerant and a hydrofluorocarbon and/or hydrocarbon, at preferably 1-200 parts by mass and more preferably 10-100 parts by mass as the total of the hydrofluorocarbon and hydrocarbon with respect to 100 parts by mass of carbon dioxide.

The refrigerating machine oil of the invention will normally be used in a refrigerating air conditioner in the form of a refrigerating machine fluid composition comprising it in admixture with a carbon dioxide-containing refrigerant such as described above. The mixing proportion of the refrigerating machine oil and refrigerant in the composition is not particularly restricted, but the refrigerating machine oil content is preferably 1-500 parts by mass and more preferably 2-400 parts by mass with respect to 100 parts by mass of the refrigerant.

The refrigerating machine oil and working fluid composition for a refrigerating machine according to the invention have excellent electrical characteristics and low hygroscopicity, and are therefore suitable for use in room air conditioners, package air conditioners and cold storage chambers having reciprocating or rotating sealed compressors. The refrigerating machine oil and working fluid composition for a refrigerating machine according to the invention may also be suitably used in cooling devices of automobile air conditioners, dehumidifiers, water heaters, freezers, cold storage/refrigerated warehouses, automatic vending machines, showcases, chemical plants and the like. The refrigerating machine oil and working fluid composition for a refrigerating machine according to the invention may also be suitably used in devices with centrifugal compressors.

EXAMPLES

The present invention will now be explained in greater detail based on examples and comparative examples, with the understanding that these examples are in no way limitative on the invention.

[Fatty Acid Composition]

The compositions of fatty acid A and fatty acid B used in the examples are listed in Table 1.

TABLE 1

| | | Fatty acid A | | Fatty acid B | |
|---|---|---|---|---|---|
| | Carbon number of fatty acids | Straight-chain fatty acids | Branched fatty acids | Straight-chain fatty acids | Branched fatty acids |
| Fatty acid composition (% by mole) | 5-9 | 0.0 | 0.0 | 0.0 | 0.0 |
| | 10 | 0.0 | 2.0 | 0.0 | 96.0 |
| | 11 | 0.0 | 0.0 | 0.0 | 0.0 |
| | 12 | 0.0 | 0.0 | 0.0 | 0.0 |
| | 13 | 0.0 | 95.0 | 0.0 | 2.0 |
| | 14-22 | 0.0 | 3.0 | 0.0 | 0.0 |
| | Other fatty acids | 0 | | 0 | |
| Percentage of C10-C13 branched fatty acids (% by mole) | | 97.0 | | 98.0 | |

Examples 1-10, Comparative Examples 1-6

For Examples 1-10 and Comparative Examples 1-6, refrigerating machine oils were prepared using base oils 1-16 listed below. The properties of the obtained refrigerating machine oils are shown in Tables 2 to 5.

(Base Oils)

Base oil 1: Ester of fatty acid A and pentaerythritol.

Base oil 2: Ester of mixed fatty acid comprising fatty acid A and n-decanoic acid (mixing ratio (mass ratio):fatty acid A/n-decanoic acid=85/15) and pentaerythritol.

Base oil 3: Ester of mixed fatty acid comprising fatty acid A and 3,5,5-trimethylhexanoic acid (mixing ratio (mass ratio): fatty acid A/3,5,5-trimethylhexanoic acid=85/15) and pentaerythritol.

Base oil 4: Ester of mixed fatty acid comprising fatty acid A and n-decanoic acid (mixing ratio (mass ratio):fatty acid A/n-decanoic acid=70/30) and pentaerythritol.

Base oil 5: Ester of mixed fatty acid comprising fatty acid A and 3,5,5-trimethylhexanoic acid (mixing ratio (mass ratio): fatty acid A/3,5,5-trimethylhexanoic acid=70/30) and pentaerythritol.

Base oil 6: Ester of fatty acid B and pentaerythritol.

Base oil 7: Ester of mixed fatty acid comprising fatty acid B and n-decanoic acid (mixing ratio (mass ratio):fatty acid B/n-decanoic acid=85/15) and pentaerythritol.

Base oil 8: Ester of mixed fatty acid comprising fatty acid B and 3,5,5-trimethylhexanoic acid (mixing ratio (mass ratio): fatty acid B/3,5,5-trimethylhexanoic acid=85/15) and pentaerythritol.

Base oil 9: Ester of mixed fatty acid comprising fatty acid B and n-decanoic acid (mixing ratio (mass ratio):fatty acid B/n-decanoic acid=70/30) and pentaerythritol.

Base oil 10: Ester of mixed fatty acid comprising fatty acid B and 3,5,5-trimethylhexanoic acid (mixing ratio (mass ratio): fatty acid B/3,5,5-trimethylhexanoic acid=70/30) and pentaerythritol.

Base oil 11: Ester of fatty acid mixture of 2-ethylhexanoic acid and 3,5,5-trimethylhexanoic acid (mixing ratio: 2-ethylhexanoic acid/3,5,5-trimethylhexanoic acid=50/50 (molar ratio)) and dipentaerythritol.

Base oil 12: Ester of oleic acid and pentaerythritol.

Base oil 13: Ester of stearic acid and pentaerythritol.

Base oil 14: Ester of mixed fatty acid comprising fatty acid A and n-decanoic acid (mixing ratio (mass ratio):fatty acid A/n-decanoic acid=40/60) and pentaerythritol.

Base oil 15: Ester of mixed fatty acid comprising fatty acid A and 3,5,5-trimethylhexanoic acid (mixing ratio (mass ratio): fatty acid A/3,5,5-trimethylhexanoic acid=40/60) and pentaerythritol.

Base oil 16: Polypropyleneglycol monomethyl ether.

Each of the refrigerating machine oils obtained in Examples 1-10 and Comparative Examples 1-6 was subjected to an evaluation test in the following manner.

(Refrigerant Compatibility)

Following the method of JIS-K-2211, "Refrigerating machine Oils", "Test Method For Compatibility With Refrigerants", 2 g of refrigerating machine oil was added to 18 g of carbon dioxide refrigerant, and it was observed whether the carbon dioxide refrigerant and refrigerating machine oil mutually dissolved at 0° C., assigning an evaluation of "compatible", "opaque" or "separated". The results are shown in Tables 2 to 5.

(Refrigerant Dissolved Viscosity)

The apparatus shown in FIG. 1 comprises a pressure vessel 5 (stainless steel, internal volume: 200 ml) that includes a viscometer 1, pressure gauge 2, thermocouple 3 and stirrer 4, a thermostatic bath 6 for temperature control in the pressure vessel 5, and a sampling cylinder 8 connected to the pressure vessel 5 through a fluid channel 7 and including a valve. The sampling cylinder 8 and fluid channel 7 are detachable, and the sampling cylinder 8 can be weighed during measurement, after vacuum deaeration, or after weighing out the carbon dioxide refrigerant and refrigerating machine oil mixture. The thermocouple 3 and thermostatic bath 6 are both electrically connected to temperature control means (not shown), and a data signal for the temperature of the sample oil (or mixture of carbon dioxide refrigerant and refrigerating machine oil) is sent from the thermocouple 3 to the temperature control means while a control signal is sent from the temperature control means to the thermostatic bath 6 to allow control of the temperature of the refrigerating machine oil or mixture. The viscometer 1 is electrically connected to an information processor (not shown), and measurement data for the viscosity of the fluid in the pressure vessel 5 is sent from the viscometer 1 to the information processor to allow measurement of the viscosity under prescribed conditions.

For this test, 100 g of refrigerating machine oil was placed in the pressure vessel 5 first and the vessel was vacuum deaerated, after which the carbon dioxide refrigerant was introduced and the mixture of the carbon dioxide refrigerant and refrigerating machine oil was stirred with a stirrer 4 and adjusted to 5 MPa at 40° C. while removing the refrigerant. After stabilization, the viscosity of the mixture of the carbon dioxide refrigerant and refrigerating machine oil mixture was measured. The measurement results for the refrigerant dissolved viscosity at 40° C. are shown in Tables 2 to 5.

(Electrical Insulating Properties)

The volume resistivity of the refrigerating machine oil at 25° C. was measured according to JIS-C-2101, "Electrical Insulation Oil Test Method". The results are shown in Tables 2 to 5.

(Thermostability)

After sealing 90 g of refrigerating machine oil, 10 g of carbon dioxide refrigerant and a catalyst (iron, copper and aluminum wires) in an autoclave, the mixture was heated to 200° C. and kept for 2 weeks. The total acid value of the refrigerating machine oil was measured after 2 weeks. The results are shown in Tables 2 to 5.

(Lubricity)

Running-in was performed for 1 minute under a load of 150 lb at a refrigerating machine oil temperature of 100° C., according to the ASTM D 2670 "Standard Test Method for Measuring Wear Properties of Fluid Lubricants (Falex Pin and Vee Block Method)". Next, the tester was operated for 2 hours under a load of 250 lb while blowing in 10 L/h of carbon dioxide refrigerant, and the wear of the test journal (pin) was measured after the test. The results are shown in Tables 2 to 5.

TABLE 2

| | Example 1 | Example 2 | Example 3 | Example 4 | Example 5 |
|---|---|---|---|---|---|
| Base oil | Base oil 1 | Base oil 2 | Base oil 3 | Base oil 4 | Base oil 5 |
| Kinematic viscosity at 40° C. ($mm^2/s$) | 179.8 | 135.2 | 153.4 | 103.3 | 131.6 |
| Kinematic viscosity at 100° C. ($mm^2/s$) | 15.1 | 13.1 | 13.7 | 11.4 | 12.5 |
| C10-C13 fatty acids (% by mole) | 100 | 85 | 85 | 70 | 70 |
| Proportion of tertiary carbons in fatty acid constituent elements (% by mass) | 5.0 | 4.5 | 7.0 | 3.5 | 9.0 |
| Refrigerant compatibility | Compatible | Compatible | Compatible | Compatible | Compatible |
| Refrigerant dissolved viscosity ($mm^2/s$) | 13 | 12 | 12 | 12 | 10 |
| Volume resistivity (TΩm) | 4.5 | 3.8 | 5.6 | 5.3 | 2.4 |
| Thermal stability (acid value, mgKOH/g) | 0.39 | 0.34 | 0.29 | 0.25 | 0.33 |
| Lubricity (wear, mg) | 10 | 9 | 12 | 9 | 13 |

TABLE 3

| | Example 6 | Example 7 | Example 8 | Example 9 | Example 10 |
|---|---|---|---|---|---|
| Base oil | Base oil 6 | Base oil 7 | Base oil 8 | Base oil 9 | Base oil 10 |
| Kinematic viscosity at 40° C. ($mm^2/s$) | 84.0 | 72.8 | 81.3 | 63.4 | 78.8 |
| Kinematic viscosity at 100° C.($mm^2/s$) | 9.7 | 9.1 | 9.5 | 8.5 | 9.2 |
| C10-13 fatty acids (% by mole) | 100 | 85 | 85 | 70 | 70 |
| Proportion of tertiary carbons in fatty acid constituent elements (% by mass) | 5.0 | 4.5 | 7.0 | 3.5 | 9.0 |
| Refrigerant compatibility | Compatible | Compatible | Compatible | Compatible | Compatible |
| Refrigerant dissolved viscosity ($mm^2/s$) | 8.2 | 8.3 | 7.0 | 7.9 | 6.8 |
| Volume resistivity (TΩm) | 3.4 | 4.5 | 5.6 | 4.3 | 2.9 |
| Thermal stability (acid value, mgKOH/g) | 0.31 | 0.29 | 0.34 | 0.42 | 0.31 |
| Lubricity (wear, mg) | 15 | 13 | 16 | 12 | 17 |

TABLE 4

| | Comp. Ex. 1 | Comp. Ex. 2 | Comp. Ex. 3 | Comp. Ex. 4 | Comp. Ex. 5 |
|---|---|---|---|---|---|
| Base oil | Base oil 11 | Base oil 12 | Base oil 13 | Base oil 14 | Base oil 15 |
| Kinematic viscosity at 40° C. ($mm^2/s$) | 68.0 | 68.0 | Solid | 62.8 | 98.0 |
| Kinematic viscosity at 100° C. ($mm^2/s$) | 8.3 | 12.2 | — | 8.8 | 10.4 |
| C10-C13 fatty acids (% by mole) | 0 | 0 | 0 | 40 | 40 |
| Proportion of tertiary carbons in fatty acid constituent elements (% by mass) | 0 | 0 | 0 | 1.8 | 12 |
| Refrigerant compatibility | Compatible | Separated | Separated | Separated | Compatible |

TABLE 4-continued

| | Comp. Ex. 1 | Comp. Ex. 2 | Comp. Ex. 3 | Comp. Ex. 4 | Comp. Ex. 5 |
|---|---|---|---|---|---|
| Refrigerant dissolved viscosity ($mm^2/s$) | 3.2 | 11 | — | 13 | 3.8 |
| Volume resistivity (TΩm) | 4.5 | 2.8 | — | 3.4 | 4.6 |
| Thermal stability (acid value, mgKOH/g) | 0.35 | 1.03 | — | 0.42 | 0.39 |
| Lubricity (wear, mg) | 25 | 20 | — | 18 | 26 |

TABLE 5

| | Comp. Ex. 6 |
|---|---|
| Base oil | Base oil 16 |
| Kinematic viscosity at 40° C. ($mm^2/s$) | 150 |
| Kinematic viscosity at 100° C. ($mm^2/s$) | 24.9 |
| C10-C13 fatty acids (% by mole) | — |
| Proportion of tertiary carbons in fatty acid constituent elements (% by mass) | — |
| Refrigerant compatibility | Separated |
| Refrigerant dissolved viscosity ($mm^2/s$) | 22 |
| Volume resistivity (TΩm) | 0.00032 |
| Thermal stability (acid value, mgKOH/g) | 2.54 |
| Lubricity (wear, mg) | 24 |

As seen by the results in Tables 2 to 5, the refrigerating machine oils of Examples 1-10, when used with carbon dioxide refrigerants, exhibited an excellent balance of performance in terms of refrigerant compatibility, electrical insulating properties, thermostability, lubricity and kinematic viscosity.

The invention claimed is:

1. A refrigerating machine oil comprising an ester of a polyhydric alcohol and fatty acids with a content of C13 branched fatty acids of 50% by mole or greater, and a refrigerant comprising a carbon dioxide refrigerant.

2. A refrigerating machine oil-according to claim 1, wherein the proportion of tertiary carbons among the constituent carbons of the fatty acids is 2% by mass or greater, as measured by $^{13}$C-NMR analysis.

3. A working fluid composition for a refrigerating machine, the working fluid composition comprising an ester of a polyhydric alcohol and fatty acids with a content of C13 branched fatty acids of 50% by mole or greater, and a refrigerant, wherein the refrigerant contains a carbon dioxide refrigerant.

4. The refrigerating machine oil according to claim 1, comprising an ester of a polyhydric alcohol and fatty acids with a content of C13 branched fatty acids of 60-100% by mole.

5. The refrigerating machine oil according to claim 4, comprising an ester of a polyhydric alcohol and fatty acids with a content of C13 branched fatty acids of 70-100% by mole.

6. The working fluid composition for a refrigerating machine according to claim 3, comprising an ester of a polyhydric alcohol and fatty acids with a content of C13 branched fatty acids of 60-100% by mole.

7. The working fluid composition for a refrigerating machine according to claim 6, comprising an ester of a polyhydric alcohol and fatty acids with a content of C13 branched fatty acids of 70-100% by mole.

* * * * *